US009732601B2

(12) United States Patent
Delchambre et al.

(10) Patent No.: US 9,732,601 B2
(45) Date of Patent: Aug. 15, 2017

(54) ELECTRICAL DEVICE FOR WELL STIMULATION

(71) Applicant: ENE29 S.AR.L., Luxembourg (LU)

(72) Inventors: Michael Delchambre, Toulouse (FR); Laurent Feriol, Lauzerville (FR); Nicolas Innocenti, Toulouse (FR); Jesus Minakata, Calgary (CA); Salvador Moncho, Malakoff (FR)

(73) Assignee: ENE29 S.AR.L., Luxembourg (LU)

( * ) Notice: Subject to any disclaimer, the term of this patent is extended or adjusted under 35 U.S.C. 154(b) by 208 days.

(21) Appl. No.: 14/650,301

(22) PCT Filed: Dec. 6, 2013

(86) PCT No.: PCT/EP2013/075792
§ 371 (c)(1),
(2) Date: Jun. 6, 2015

(87) PCT Pub. No.: WO2014/086969
PCT Pub. Date: Jun. 12, 2014

(65) Prior Publication Data

US 2015/0308249 A1 Oct. 29, 2015

(30) Foreign Application Priority Data

Dec. 7, 2012 (FR) ..... 12 61804

(51) Int. Cl.
*E21B 17/01* (2006.01)
*E21B 43/25* (2006.01)
(Continued)

(52) U.S. Cl.
CPC ..... *E21B 43/25* (2013.01); *E21B 17/028* (2013.01); *E21B 17/042* (2013.01); *E21B 43/003* (2013.01)

(58) Field of Classification Search
CPC ..... E21B 17/028; H01R 9/0527; H01R 24/40
See application file for complete search history.

(56) References Cited

U.S. PATENT DOCUMENTS 3,518,609 A * 6/1970 Fontenot, Jr. ..... E21B 17/028 175/104
3,831,443 A 8/1974 Planche
(Continued)

FOREIGN PATENT DOCUMENTS

EA 2006 01929 A1 4/2008
FR 2168920 A1 9/1973
(Continued)

*Primary Examiner* — John Kreck
(74) *Attorney, Agent, or Firm* — Im IP Law; C. Andrew Im

(57) ABSTRACT

An electrical device for well stimulation comprising a plurality of sections configured to be assembled, end to end, to form a tool. The tool comprises first and second electrodes. The second electrode is an electrically insulated peripheral electrode of the first electrode. The first and second electrodes of the tool forming, at one of the ends of the tool, a stimulation head. Additionally, one end of a body of a first section comprises a peripheral ring that is rotatably movable and translatably immobile relative to the body of the first section. The peripheral ring comprises a thread configured to engage with a thread of the second electrode of one end of a second section.

20 Claims, 3 Drawing Sheets

(51) Int. Cl.

| | |
|---|---|
| ***E21B 43/00*** | (2006.01) |
| ***E21B 17/02*** | (2006.01) |
| ***E21B 17/042*** | (2006.01) |

(56) References Cited

U.S. PATENT DOCUMENTS

| | | | | |
|---|---|---|---|---|
| 4,278,942 | A | 7/1981 | Bonnet et al. | |
| 4,345,650 | A | 8/1982 | Wesley | |
| 4,479,680 | A | 10/1984 | Wesley et al. | |
| 4,997,044 | A | 3/1991 | Stack | |
| 6,483,310 | B1 | 11/2002 | Meador | |
| 6,650,209 | B2 * | 11/2003 | Plummer ..... | H01P 1/045 174/88 C |

FOREIGN PATENT DOCUMENTS

| | | | |
|---|---|---|---|
| GB | 2503935 | * | 1/2014 |
| WO | 90/13830 | A1 | 11/1990 |

* cited by examiner

ELECTRICAL DEVICE FOR WELL STIMULATION

RELATED APPLICATIONS

This application is a §371 application from PCT/EP2013/075792 filed Dec. 6, 2013, which claims priority from French Patent Application No. 12 61804 filed Dec. 7, 2012, each of which is herein incorporated by reference in its entirety.

TECHNICAL FIELD

The present invention belongs to the field of well stimulation.

"Well stimulation" should be understood to mean the generation of a shockwave in a natural or drilling well. A well stimulation notably makes it possible to improve the production of a well for extracting an underground resource (oil, natural gas, water, etc.), to perform a seismological survey (for example by performing measurements by means of a sensor on the surface), to produce a fracturing of underground rock, etc.

STATE OF THE ART

In the field of well stimulation, it is known practice to use a tool of elongate form suitable for being inserted into a well obtained by drilling.

Such a tool comprises a first electrode and a second electrode, electrically insulated from one another, extending substantially from one end to the other of said tool. Said first and second electrodes of the tool form, at one end of said tool, a stimulation head. The stimulation head generally comprises a chamber intended to receive a fluid, into which said first and second electrodes emerge. Exemplary embodiments of such a tool are known:

- from the U.S. Pat. No. 4,345,650, which describes a tool implemented to improve the production of an underground resource extraction well,
- from the international patent application WO9013830, which describes a tool implemented to perform a seismological survey,
- from the U.S. Pat. No. 4,479,680, which describes a tool implemented to produce a fracture in underground rock.

In well stimulation operations, the tool is inserted into said well with the stimulation head at the bottom, and is lowered to the point where the stimulation is to be performed. Once the stimulation point is reached, pulses of high intensity electrical current (possibly exceeding one hundred or so kilo-amps) are sent into the first electrode. A current arc is then formed, in the chamber of the stimulation head, between the first electrode and the second electrode (generally linked to the electrical ground). Said current arc makes it possible to form a shockwave which will stimulate the well. For example, such a shockwave can make it possible to unplug an extraction well.

Such a tool has a length that is generally between three and twenty meters, and is also very heavy, of the order of several hundreds of kilograms.

In order notably to facilitate the transport and handling thereof, such a tool generally takes the form of a plurality of sections intended to be joined end-to-end. Each section then comprises a first electrode and a second electrode electrically insulated from one another. The first electrode of the tool is thus formed by the connection of the first electrodes of said sections, and the second electrode of the tool is formed by the connection of the second electrodes of said sections.

The operations of joining said sections are, however, very difficult, notably because each section is very heavy.

OBJECT AND SUMMARY OF THE INVENTION

The main object of the present invention is to propose a solution which allows for a joining of the sections of a tool which is faster and simpler than the prior art solutions.

Furthermore, another objective of the present invention is to propose a solution which allows, in certain embodiments, a mechanical coupling between the sections which is both robust (resistant to a load of several hundreds of kilograms) and tight (resistant to a pressure of the order of several hundreds of bar at a temperature greater than one hundred or so degrees Celsius).

Furthermore, another objective of the present invention is to propose a solution which allows, in certain embodiments, an electrical coupling which is both robust (resistant to very high voltages—several tens of kilovolts—and very strong currents—several tens of kilo-amps) and effective in order to limit the electrical energy losses, the degradation of the electrical contacts and the electrical creeping by skin effect.

To this end, the invention relates to an electrical well stimulation device, said device comprising a plurality of sections, said sections being suitable for being joined end-to-end so as to form a tool comprising a first electrode formed by first electrodes of said sections and a second electrode formed by second electrodes of said sections, said second electrode being a peripheral electrode electrically insulated from said first electrode, and said first electrode and second electrode of the tool forming, at one of the ends of said tool, a stimulation head.

Furthermore, one end of a body of a first section comprises a peripheral ring which is rotationally mobile relative to said body of said first section and translationally immobile relative to said body of said first section, said peripheral ring comprising a threading suitable for cooperating with a threading of the second electrode of one end of a second section to join said second section to said first section.

Furthermore, if the threading of the peripheral ring is an external threading, then the second electrode of the first section comprises an extension between the peripheral ring and a termination of the end of said first section. If it is the threading of the second electrode of the second section which is an external threading, then the second electrode of the second section comprises an extension between the threading and a termination of the end of said second section. Finally, the first section and/or the second section comprise means, called "electrical contact means", suitable for establishing an electrical contact between the second electrodes of the first section and the second section in a zone of contact of the extension, when the second section is joined onto the first section.

Because of the peripheral ring, it will be understood that it is possible to directly join the second section onto the first section, without requiring any intermediate part between said first and second sections.

The joining of the second section onto the first section will also be easier. In effect, once the threading of the second section is engaged with the threading of the peripheral ring, it will be sufficient, to produce the join, to rotate said peripheral ring while keeping the body of the second section rotationally immobile relative to the body of the first section.

Furthermore, the electrical contact means, arranged thus on the first section and/or the second section, make it possible to protect the faces, the seals and the threadings of the peripheral ring and of the second section. In effect, because of the electrical current levels considered, the circulation of the electrical current via the threadings could result in a seizing together, even a welding together of said threadings. It should be noted that the end of the section which bears the external threading must necessarily be engaged in the end of the other section, which then takes the form of a sleeve with an internal threading. Consequently, the extension of the second electrode of the section which bears the external threading is closer to the electrically insulating material, which separates said second electrode from the first electrode, than the second electrode of the other section. By skin effect, the electrical current has a tendency to circulate, in the second electrode of the tool, as close as possible to said electrically insulating material. It will therefore be understood that, by skin effect, the current will have a tendency to circulate mainly via the electrical contact means, such that the circulation of electrical current via the threadings will be limited.

In particular embodiments, the electrical well stimulation device comprises one or more of the following features, taken in isolation or in all technically possible combinations.

In a particular embodiment, the zone of contact is a peripheral zone of the extension.

Such arrangements make it possible to ensure a greater electrical contact surface area between the respective second electrodes of the first section and of the second section, while maximizing the distance between the electrical contact means and the first electrode.

In a particular embodiment, the extension comprises a peripheral seal arranged between the zone of contact of said extension and the external threading.

The use of a peripheral seal makes it possible to ensure the tightness of the mechanical coupling, and therefore to avoid the formation of current micro-arcs. Such an arrangement of the peripheral seal is also advantageous in that it makes it possible to protect said peripheral seal. In effect, as has been described for the threadings, the electrical current, by skin effect, will have a tendency to circulate mainly via the electrical contact means, such that the electrical current to which said peripheral seal could be subjected will be limited.

In a particular embodiment, the electrical contact means comprise an electrically conductive peripheral seal, a toroidal spring and/or an electrically conductive foil.

In a particular embodiment, the first section and the second section comprise respective means, called "rotation blocking means", suitable for cooperating to rotationally immobilize a body of the second section relative to the body of the first section when said second section is joined onto said first section.

Such arrangements make it possible to further simplify the joining of the second section onto the first section. In effect, once the rotation blocking means of the second section have been engaged with the rotation blocking means of the first section, it will be sufficient, to produce the join, to rotate said peripheral ring.

In a particular embodiment, in which the device comprises at least three sections, the rotation blocking means of at least one section are not geometrically suited to cooperate with the rotation blocking means of at least one other section.

Such arrangements make it possible to avoid joining together sections which are not designed to be joined together. In other words, the rotation blocking means have, in this embodiment, an additional polarizing function.

In a particular embodiment, the peripheral ring and/or the body of the first section comprise an indentation forming a bearing surface suitable for cooperating with gripping means.

Such provisions make it possible to facilitate the handling of the peripheral ring and/or of the body of the first section, and therefore facilitate the joining of the second section onto the first section. For example, the indentation takes the form of a blind hole or of a flat.

In a particular embodiment, the first section comprises another peripheral ring that is rotationally mobile and translationally immobile relative to the body of said first section, said other peripheral ring comprising a threading suitable for cooperating with a threading of the second electrode of a third section to join said third section onto said first section.

DESCRIPTION OF THE FIGURES

The invention will be better understood on reading the following description, given as a nonlimiting example, and with reference to the figures which represent.

In these figures, identical references from one figure to another denote identical or analogous elements. For reasons of clarity, the elements represented are not to scale, unless stated otherwise.

DETAILED DESCRIPTION OF EMBODIMENTS

Figure 1:
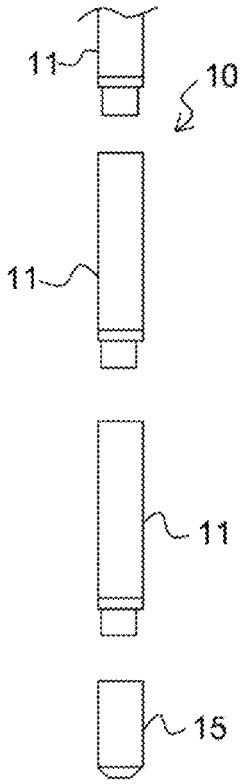
FIGS. 1, 2, and 3: views before joining, after joining and in half-cross section after joining of an electrical well stimulation device.
Figure 2:
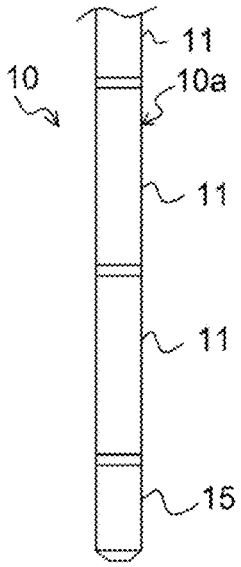
Figure 3:
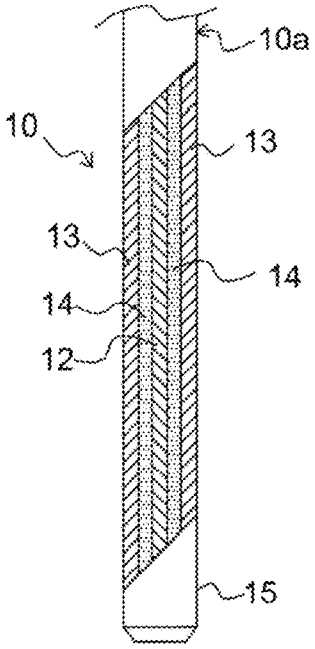

FIGS. 1, 2 and 3 schematically represent an electrical well stimulation device 10.

Hereinafter in the description, the nonlimiting case of a stimulation device 10 for a well for extracting an underground resource, such as oil, natural gas, water, etc., will be assumed. However, as indicated previously, "well stimulation" should be understood generally to mean the generation of a shockwave in a natural or drilling well. Such a well stimulation can be implemented to improve the production of an underground resource extraction well, to perform a seismological survey, to produce a fracturing of underground rock, etc.

As illustrated by FIG. 1, the electrical stimulation device 10 comprises a plurality of sections 11 adapted to be joined end-to-end.

FIG. 2 represents said electrical stimulation device 10 after said sections 11 have been joined so as to obtain a tool 10*a*. FIG. 3 schematically represents a view in half-cross section of the tool 10*a* of FIG. 2.

It should be noted that "electrical stimulation device" denotes all of the sections 11, whether joined or not, whereas "tool" denotes the object obtained by the joining of the sections 11. Consequently, all the various sections 11 joined together will be able to be denoted hereinbelow in the description as "electrical stimulation device" or "tool".

As illustrated by FIG. 3, the tool 10*a* comprises a first electrode 12 and a second electrode 13. Said first electrode 12 and said second electrode 13 are electrically insulated from one another, throughout the body of the tool 10*a*, by an electrically insulating layer 14.

Said first and second electrodes 12, 13 of the tool 10*a* form, at one end of said tool 10*a*, a stimulation head 15, which is considered to be known to those skilled in the art.

Each section 11 comprises, for example, a part of the first electrode 12, a part of the electrically insulating layer 14 and a part of the second electrode 13 of the tool 10*a*.

Hereinafter in the description the nonlimiting case will be assumed in which the second electrode 13 is a peripheral electrode surrounding the electrically insulting layer 14, said electrically insulating layer 14 surrounding the first electrode 12 which constitutes a central core of the tool 10*a*.

It should be noted that the tool 10*a* can comprise other elements not represented in FIGS. 1 to 3. For example, one or more sections 11 of the tool 10*a* may each comprise an electrical energy accumulator, an electrical protection device, etc.

The present invention relates to a refinement made to the joining means of at least two sections of the electrical stimulation device 10, hereinafter respectively denoted first section 11*a* and second section 11*b*. It should be noted that this refinement is preferably implemented for the joining means of all the sections 11 of said electrical stimulation device 10.

More particularly, one end of the body of the first section 11*a* comprises a peripheral ring 16. Said peripheral ring 16 is rotationally mobile relative to said body of said first section 11*a* and is translationally immobile relative to said body of said first section 11*a*. Furthermore, said peripheral ring 16 comprises a threading adapted to cooperate with a threading 133 of one end of a body of the second section 11*b* to join said second section 11*b* onto said first section 11*a*.

Figure 4:
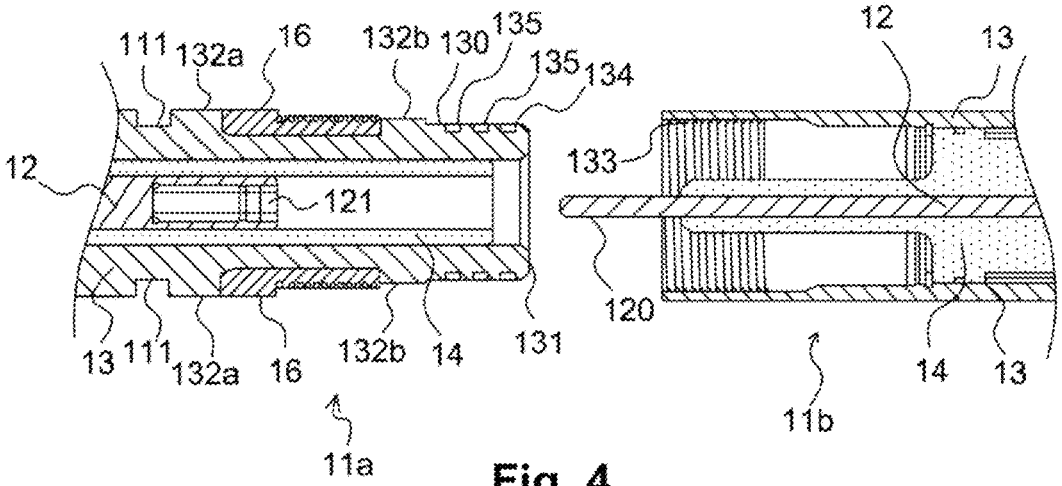
FIGS. 4 and 5: cross-sectional views of a first section and of a second section of an electrical well stimulation device according to a particular embodiment, before joining and after joining.
Figure 5:
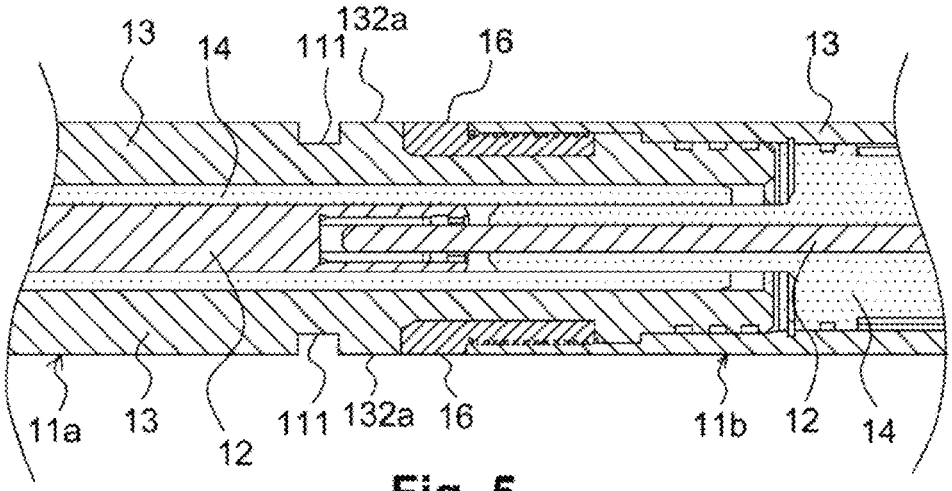
Figure 6:
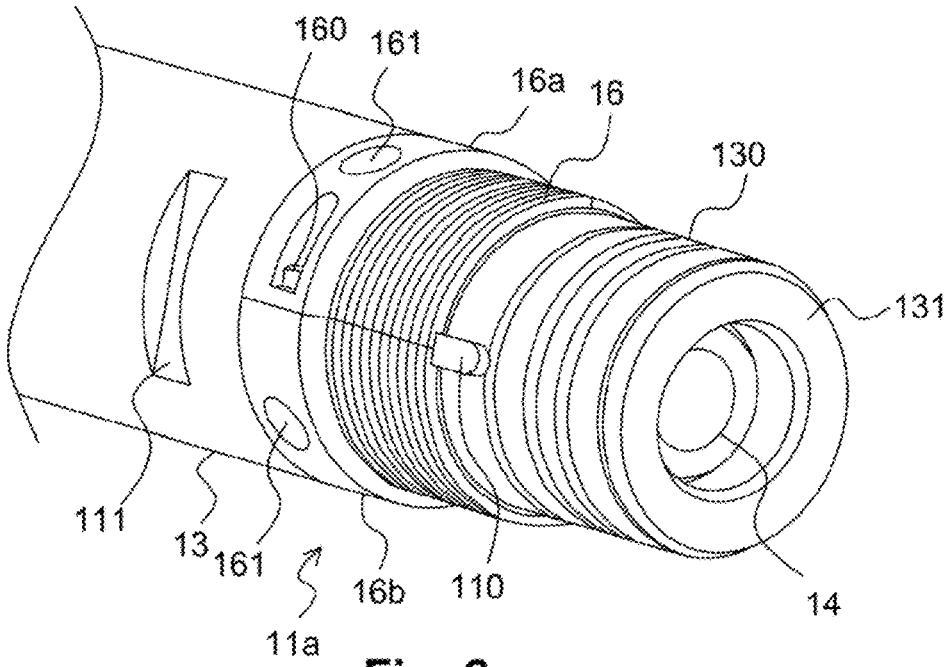
FIG. 6: a perspective view of the first section of FIG. 4, FIG. 7: a cross-sectional view of a first section, of a second section and of a third section of an electrical stimulation device according to a particular embodiment, after joining.

FIGS. 4 and 5 schematically represent cross-sectional views of an exemplary embodiment of the first and second sections 11*a*, 11*b*, respectively before joining and after joining FIG. 6 schematically represents, in perspective, the first section 11*a* of FIGS. 4 and 5.

In the embodiment illustrated by FIGS. 4 and 5, the threading of the peripheral ring 16 of the first section 11*a* is an external threading, that is to say a threading arranged on the face of the peripheral ring 16 located on the side opposite the first electrode 12 forming the central core of said first section 11*a*. Furthermore, the second electrode 13 of the first section 11*a* comprises an extension 130 between the peripheral ring 16 and a termination 131 of the end of said first section 11*a*.

As illustrated by FIG. 6, the peripheral ring 16 is, for example, produced by means of two half-rings 16*a*, 16*b* joined between two peripheral abutments 132*a*, 132*b* of the second electrode 13 of the first section 11*a*. The two half-rings 16*a*, 16*b* are joined together by any appropriate means, for example by means of screws 160. Because the peripheral ring 16 is arranged between the two abutments 132*a*, 132*b* of the second electrode 13 of the first section 11*a*, said peripheral ring 16, while being rotationally mobile relative to said second electrode 13 of said first section 11*a*, is translationally immobile relative to said second electrode 13 of said first section 11*a*.

On the side of the second section 11*b*, the second electrode 13 forms, at the end of said second section 11*b*, a sleeve inside which the extension 130 of the second electrode 13 of the first section 11*a* can penetrate. The threading 133 of the second section 11*b*, produced on said sleeve, is an internal threading, that is to say a threading arranged on the face of said sleeve located on the side of the first electrode 12 forming the central core of the second section.

As illustrated by FIG. 5, the internal threading 133 of the second electrode 13 of the second section 11*b* is adapted to cooperate with the external threading of the peripheral ring 16 of the first section 11*a* to join said second section 11*b* onto said first section 11*a*.

Because of the presence of the peripheral ring 16, the joining of the second section 11*b* onto the first section 11*a* is simple to form. In effect, once the threading 133 of the second section 11*b* has been engaged with the threading of the peripheral ring 16, it will be sufficient, to produce the join, to rotate said peripheral ring 16 while keeping the body of the second section 11*b* rotationally immobile relative to the body of the first section 11*a*.

In order to further facilitate the joining of the second section 11*b* onto the first section 11*a*, the peripheral ring 16 and/or the body of the first section 11*a* comprise an indentation forming a bearing surface suitable for cooperating with handling means.

In the example illustrated by FIG. 6, the peripheral ring 16 and the body of the first section 11*a* both comprise such indentations, in order to be able to immobilize the body of the first section 11*a* when the peripheral ring 16 is rotated. More particularly, the peripheral ring 16 comprises, in the example illustrated by FIG. 6, blind holes 161 suitable for cooperating with a pin wrench, and the body of the first section 11*a* comprises flats 111. According to other examples, there is nothing to preclude considering other forms of indentations.

In a preferred embodiment, the first section 11*a* and the second section 11*b* comprise respective means, called "rotation blocking means", adapted to cooperate to rotationally immobilize the body of the second section 11*b* relative to the body of the first section 11*a* when joining said second section 11*b* onto said first section 11*a*.

The presence of such rotation blocking means makes it possible to further facilitate the joining of the second section 11*b* onto the first section 11*a*. In effect, once the rotation blocking means of the second section 11*b* have been engaged with the rotation blocking means of the first section 11*a*, it is sufficient, to produce the join, to rotate the peripheral ring 16 relative to the body of the first section 11*a*.

In the example illustrated by FIG. 6, the rotation blocking means are, for the first section 11*a*, in the form of a key 110. For the second section 11*b*, said rotation blocking means are, for example, in the form of a groove (not represented in the figures) in which said key can slide while the second section 11*b* is being joined onto the first section 11*a*.

After joining, the end of the second electrode 13 of the second section 11*b* surrounds the extension 130 of the second electrode 13 of the first section 11*a* and a part of the peripheral ring 16 of said first section 11*a*.

The electrical contact between the first electrode 12 of the first section 11*a* and the first electrode 12 of the second section 11*b* can be established by using any suitable means known to those skilled in the art. In the example illustrated by FIGS. 4 and 5, the end of the first electrode 12 of the first section 11*a* forms a sleeve 121 suitable for receiving an extension 120 of the first electrode 12 of the second section 11*b*. The extension 120 of the first electrode 12 of the second section has no layer of electrically insulating material, and means are provided inside the sleeve 121 of the first electrode 12 of the first section 11*a* for establishing the electrical contact between the first electrodes. In a preferred embodiment, illustrated by FIGS. 4 and 5, the electrical contact means of the sleeve 121 are of multicontact type, for example a sleeve comprising blades with shape memory, a helical spring or even foils.

The electrical contact between the second electrode 13 of the first section 11*a* and the second electrode 13 of the second section 11*b* is, for example, established via the peripheral ring 16, the latter being optionally made of an electrically conductive material.

In a preferred embodiment, illustrated by FIGS. 4 and 5, the second electrode 13 of the first section 11*a* comprises means called "electrical contact means", suitable for establishing an electrical contact between the second electrode 13 of the second section in a contact zone of the extension 130 of the second electrode 13 of the first section 11*a*.

In the example illustrated by FIGS. 4 and 5, said electrical contact means are in the form of an electrically conductive peripheral seal 134. There is nothing to preclude, according to other examples, considering other types of electrical contact means, for example an electrically conductive foil arranged at the periphery of the extension 130 of the second electrode 13 of the first section 11*a*. Furthermore, it should be noted that the electrical contact means could be borne by the second electrode 13 of the second section 11*b*, or even by both the first section 11*a* and the second section 11*b*.

By virtue of the electrical contact established at the extension 130 of the second electrode 13, the electrical current, which by skin effect has a tendency to circulate in the second electrode 13 as close as possible to the electrically insulating layer 14, will have a tendency to circumvent the peripheral ring 16. In effect, by assuming that the electrical current circulates from the first electrode 12 of the first section 11*a* to the first electrode 12 of the second section 11*b* then returns by circulating from the second electrode 13 of the second section 11*b* to the second electrode 13 of the first section 11*a*, it can be seen that the shortest path allowing the electrical current to pass as close as possible to the electrically insulating layer 14 consists in passing through the contact zone of the extension 130 of the first section 11*a*. That said, the electrical current will have a tendency to circumvent the peripheral ring 16.

In the example illustrated by FIGS. 4 and 5, the extension 130 of the second electrode 13 of the first section 11*a* comprises two peripheral seals 135. Advantageously, said peripheral seals 135 are arranged between the contact zone of said extension 130 and the peripheral ring 16. In this way, as indicated previously, the electrical current will have a tendency to circumvent said peripheral seals 135, and the risks of the latter being damaged by the circulation of the electrical current are reduced.

Figure 7:
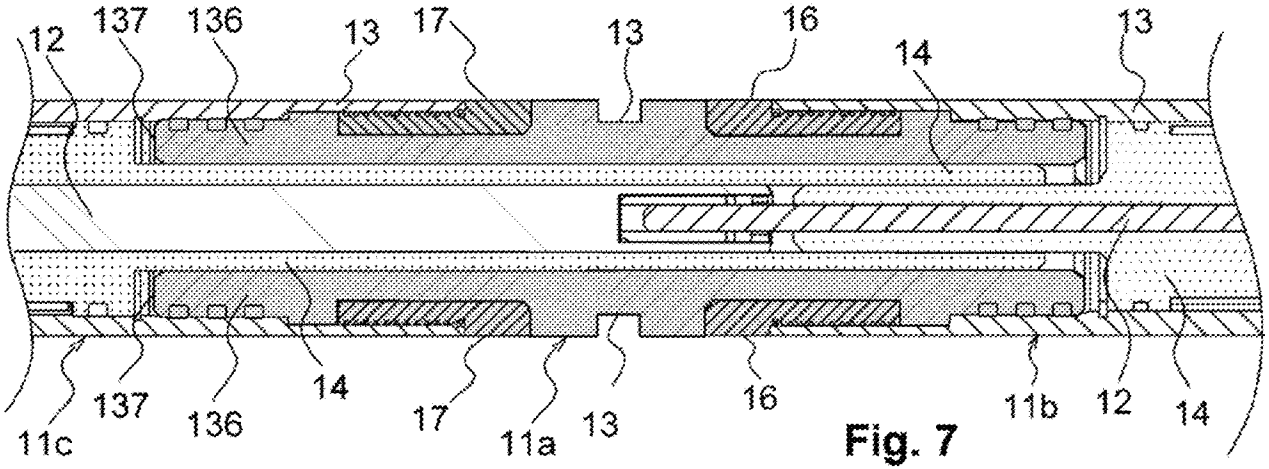

FIG. 7 schematically represents a variant embodiment of the first section 11*a* illustrated by FIGS. 4 to 6. In this variant embodiment, said first section 11*a*, (represented with grey shading in FIG. 7) comprises two peripheral rings arranged at opposite ends of said first section 11*a*.

Thus, the first section 11*a* comprises, at an end opposite the end of the peripheral ring 16 described with reference to FIGS. 4 to 6, another peripheral ring 17. Said peripheral ring 17 is rotationally mobile and translationally immobile relative to the body of the first section 11*a*. Furthermore, said peripheral ring 17 comprises a threading suitable for cooperating with a threading of one end of a body of a third section 11*c* to join said third section 11*c* onto said first section 11*a*.

In the embodiment illustrated by FIG. 7, the threading of the peripheral ring 17 of the first section 11*a* is an external threading. Furthermore, the second electrode 13 of the first section 11*a* comprises an extension 136 between the peripheral ring 17 and a termination 137 of the end of said first section 11*a*.

On the side of the third section 11*c*, the second electrode 13 forms, at the end of said third section 11*c*, a sleeve into which the extension 136 of the second electrode 13 of the first section 11*a* can penetrate. The threading of the third section 11*c*, produced on the second electrode at said sleeve, is an internal threading, that is to say a threading arranged on the face of said sleeve located on the side of the first electrode 12 forming the central core of the third section 11*c*.

As illustrated by FIG. 7, the internal threading of the second electrode 13 of the third section 11*c* is adapted to cooperate with the external threading of the peripheral ring 17 of the first section 11*a* to join said third section 11*c* onto said first section 11*a*.

Everything that has been described above concerning the peripheral ring 16 and the extension 130 can also be applied to the peripheral ring 17 and to the extension 136 of the second electrode 13 of the first section 11*a*.

In the nonlimiting example illustrated by FIG. 7, the first section 11*a* has no electrically insulating layer 14 and no first electrode 12. In effect, the respective electrically insulating layers 14 and first electrodes 12 of the second section 11*b* and of the third section 11*c* extend inside the first section 11*a*, and cooperate therein so as to ensure both the electrical continuity of the first electrode 12 and the electrical insulation between said first electrode 12 of the tool 10*a* and the second electrode 13 of the first section 11*a*.

There is nothing to preclude, according to other examples, having a first section 11*a* comprising a part of the electrically insulating layer 14 and/or a part of the first electrode 12.

Figure 8:
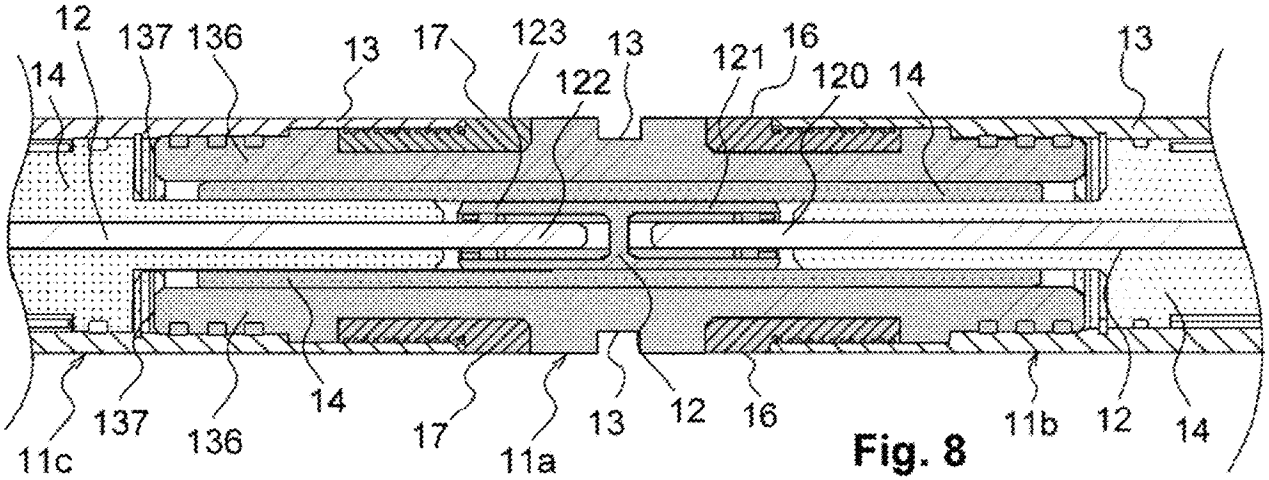
FIG. 8: a cross-sectional view of a variant embodiment of the electrical stimulation device of FIG. 7.

FIG. 8 schematically represents a variant embodiment of the first section 11*a* of FIG. 7, in which said first section 11*a* comprises a part of the electrically insulating layer 14 and a part of the first electrode 12 of the tool 10*a*. Advantageously, the first electrode 12 of the first section 11*a* forms two opposite sleeves, respectively 121 and 123, adapted to receive respective extensions 120 and 122 of the first electrode of the second section 11*b* and of the first electrode of the third section 11*c*.

Such arrangements are advantageous in that they make it possible to have identical ends for the second section 11*b* and the third section 11*c*, which facilitates their production and their internal arrangement.

More generally, it should be noted that the embodiments considered above have been described as nonlimiting examples, and that other variants can consequently be envisaged.

Notably, the electrical stimulation device 10 has been described by considering a peripheral ring 16 comprising an external threading. There is nothing to preclude, according to other examples, considering a peripheral ring 16 comprising an internal threading adapted to cooperate with an external threading produced on the periphery of the body of the second section 11*b*. The peripheral ring 16 then takes the form of a sleeve into which the end of the second section 11*b* can penetrate. In the case, described with reference to FIGS. 7 and 8, of a first section 11*a* comprising two peripheral rings 16, 17, one and/or the other of said two peripheral rings can comprise an internal threading adapted to cooperate with an external threading produced on the periphery of the second electrode 13 of another section.

Furthermore, the electrical stimulation device 10 may comprise only two sections 11, but it may also comprise more thereof. In a preferred embodiment, when said electrical stimulation device 10 comprises at least three sections, the rotation blocking means of at least one section are not geometrically adapted to cooperate with the rotation blocking means of at least one other section.

Such provisions make it possible to use said rotation blocking means as polarizers. Such a polarizing function can prove advantageous notably in the case where the sections comprise electrical energy accumulators and/or electrical protection devices. In such a case, the position of the sections relative to one another may prove essential, and will be able to be ensured by virtue of the rotation blocking means also offering a polarizing function.

In the case where said rotation blocking means are in the form of keys and associated grooves, the polarizing function will be able to be obtained by considering keys in different numbers, of different dimensions, of different positions, etc., from one section to another.

The invention claimed is:

1. An electrical well stimulation device, comprising:

a plurality of sections configured to be joined end-to-end to form a tool comprising a first electrode and a second electrode, each section comprises a part of the first electrode to form the first electrode and each section comprises a part of the second electrode to form the second electrode, the second electrode is a peripheral electrode electrically insulated from the first electrode, the first electrode and the second electrode of the tool forming a stimulation head at one of the ends of the tool;

one end of a body of a first section comprises a peripheral ring which is rotationally mobile and translationally immobile relative to the body of the first section, the peripheral ring comprises a threading configured to cooperate with a threading of a second electrode part of a second section to join the second section to the first section;

the threading of the peripheral ring is an external threading, a second electrode part of the first section comprises an extension between the peripheral ring and a termination of the end of the first section; and the first section comprises an electrical contact configured to establish an electrical connection between the second electrode part of the first section and the second electrode part of the second section in a zone of contact of the extension in response to the second section being joined onto the first section.

2. The device as claimed in claim 1, wherein the zone of contact is a peripheral zone of the extension.

3. The device as claimed in claim 1, wherein the extension comprises a peripheral seal arranged between the zone of contact of the extension and the external threading.

4. The device as claimed in claim 1, wherein the electrical contact comprises at least one of the following: an electrically conductive peripheral seal or an electrically conductive foil.

5. The device as claimed in claim 1, wherein each of the first section and the second section comprises a rotation blocker configured to cooperate with each other to rotationally immobilize a body of the second section relative to the body of the first section in response to the second section being joined onto the first section.

6. The device as claimed in claim 5, wherein the device comprises at least three sections, the rotation blocker of at least one section is geometrically configured not to cooperate with the rotation blocker of at least one other section.

7. The device as claimed in claim 1, wherein at least one of the peripheral ring or the body of the first section comprises an indentation forming a bearing surface configured to cooperate with a gripper.

8. The device as claimed in claim 7, wherein the indentation is a blind hole or a flat.

9. The device as claimed in claim 1, wherein one end of the first electrode part of the first section forms a sleeve configured to receive an extension of the first electrode part of the second section, the sleeve comprises an electrical contact configured to establish an electrical connection between the first electrode parts of the first and second sections.

10. The device as claimed in claim 1, wherein the first section comprises a second peripheral ring that is rotationally mobile and translationally immobile relative to the body of the first section, the second peripheral ring comprises a threading configured to cooperate with a threading of the second electrode part of a third section to join the third section onto the first section.

11. An electrical well stimulation device, comprising:

a plurality of sections configured to be joined end-to-end to form a tool comprising a first electrode and a second electrode, each section comprises a part of the first electrode to form the first electrode and each section comprises a part of the second electrode to form the second electrode, the second electrode is a peripheral electrode electrically insulated from the first electrode, the first electrode and the second electrode of the tool forming a stimulation head at one of the ends of the tool;

one end of a body of a first section comprises a peripheral ring which is rotationally mobile and translationally immobile relative to the body of the first section, the peripheral ring comprises a threading configured to cooperate with a threading of a second electrode part of a second section to join the second section to the first section;

the threading of the second electrode part of the second section is an external threading, the second electrode part of the second section comprises an extension between the threading and a termination of the end of the second section, the second section comprises an electrical contact configured to establish an electrical connection between the second electrode part of the first section and the second electrode part of the second section in a zone of contact of the extension in response to the second section being joined onto the first section.

12. The device as claimed in claim 11, wherein the zone of contact is a peripheral zone of the extension.

13. The device as claimed in claim 11, wherein the extension comprises a peripheral seal arranged between the zone of contact of the extension and the external threading.

14. The device as claimed in claim 11, wherein the electrical contact comprises at least one of the following: an electrically conductive peripheral seal or an electrically conductive foil.

15. The device as claimed in claim 11, wherein each of the first section and the second section comprises a rotation blocker configured to cooperate with each other to rotationally immobilize a body of the second section relative to the body of the first section in response to the second section being joined onto the first section.

16. The device as claimed in claim 15, wherein the device comprises at least three sections, the rotation blocker of at least one section is geometrically configured not to cooperate with the rotation blocker of at least one other section.

17. The device as claimed in claim 11, wherein at least one of the peripheral ring or the body of the first section comprises an indentation forming a bearing surface configured to cooperate with a gripper.

18. The device as claimed in claim 17, wherein the indentation is a blind hole or a flat.

19. The device as claimed in claim 11, wherein one end of the first electrode part of the first section forms a sleeve configured to receive an extension of the first electrode part of the second section, the sleeve comprises an electrical contact configured to establish an electrical connection between the first electrode parts of the first and second sections.

20. The device as claimed in claim 11, wherein the first section comprises a second peripheral ring that is rotationally mobile and translationally immobile relative to the body of the first section, the second peripheral ring comprises a threading configured to cooperate with a threading of the second electrode part of a third section to join the third section onto the first section.

* * * * *